US006042286A

United States Patent [19]

Pazienza

[11] Patent Number: 6,042,286

[45] Date of Patent: Mar. 28, 2000

[54] LOTION DISPENSING APPLICATOR

[76] Inventor: Karen M. Pazienza, 347 E. Main St., Moorestown, N.J. 08057

[21] Appl. No.: 09/118,093

[22] Filed: Jul. 17, 1998

[51] Int. Cl.[7] ..... A46B 5/02

[52] U.S. Cl. ..... 401/6; 401/175; 401/202

[58] Field of Search ..... 401/6, 175, 207, 401/202; 220/379, 375, 335; 15/176.6, 176.1

[56] References Cited

U.S. PATENT DOCUMENTS

| | | | |
|---|---|---|---|
| 203,817 | 5/1878 | Brock | 220/335 |
| D. 306,214 | 2/1990 | Pelphus | 401/6 X |
| D. 342,342 | 12/1993 | Maglione | 401/6 X |
| D. 346,041 | 4/1994 | Trinkaus | 401/6 X |
| 2,421,647 | 6/1947 | Peterson | 15/176.6 X |
| 3,239,096 | 3/1966 | Buono et al. | 220/375 |
| 4,171,171 | 10/1979 | Jones | 401/6 X |
| 4,213,546 | 7/1980 | Massey | 220/379 X |
| 5,573,342 | 11/1996 | Patalano | 401/6 X |

FOREIGN PATENT DOCUMENTS

| | | | |
|---|---|---|---|
| 2348551 | 4/1975 | Germany | 401/175 |
| 213755 | 3/1941 | Switzerland | 401/207 |

*Primary Examiner*—David J. Walczak

[57] ABSTRACT

A new lotion dispensing applicator for easily dispensing lotions from a refillable applicator and applying the dispensed lotions to hard to reach areas of the human body. The device includes an elongated hollow handle having a first end and a curved second end, a head member integrally formed at the curved second end, an apertured member for retaining a porous pad, the apertured member being frictionally attachable to the head member, and a lotion dispensing mechanism for forcing a quantity of lotion disposed in the elongated hollow handle from an interior thereof, through the retaining means and into the porous pad.

1 Claim, 2 Drawing Sheets

LOTION DISPENSING APPLICATOR

BACKGROUND OF THE INVENTION

1. Field of the Invention

The present invention relates to liquid dispensing applicators and more particularly pertains to a new lotion dispensing applicator for easily dispensing lotions from a refillable applicator and applying the dispensed lotions to hard to reach areas of the human body.

2. Description of the Prior Art

The use of liquid dispensing applicators is known in the prior art. More specifically, liquid dispensing applicators heretofore devised and utilized are known to consist basically of familiar, expected and obvious structural configurations, notwithstanding the myriad of designs encompassed by the crowded prior art which have been developed for the fulfillment of countless objectives and requirements.

Known prior art liquid dispensing applicators include U.S. Pat. No. 5,240,339; U.S. Pat. No. 4,861,180; U.S. Pat. No. 4,171,171; U.S. Pat. No. 5,322,382; and U.S. Pat. Des. No. 308,264.

While these devices fulfill their respective, particular objectives and requirements, the aforementioned patents do not disclose a new lotion dispensing applicator. The inventive device includes an elongated hollow handle having a first end and a curved second end, a head member integrally formed at the curved second end, a means for retaining a porous pad, the retaining means being frictionally attachable to the head member, and a lotion dispensing means for forcing a quantity of lotion disposed in the elongated hollow handle from an interior thereof, through the retaining means and into the porous pad.

In these respects, the lotion dispensing applicator according to the present invention substantially departs from the conventional concepts and designs of the prior art, and in so doing provides an apparatus primarily developed for the purpose of easily dispensing lotions from a refillable applicator and applying the dispensed lotions to hard to reach areas of the human body.

SUMMARY OF THE INVENTION

In view of the foregoing disadvantages inherent in the known types of liquid dispensing applicators now present in the prior art, the present invention provides a new lotion dispensing applicator construction wherein the same can be utilized for easily dispensing lotions from a refillable applicator and applying the dispensed lotions to hard to reach areas of the human body.

The general purpose of the present invention, which will be described subsequently in greater detail, is to provide a new lotion dispensing applicator apparatus and method which has many of the advantages of the liquid dispensing applicators mentioned heretofore and many novel features that result in a new lotion dispensing applicator which is not anticipated, rendered obvious, suggested, or even implied by any of the prior art liquid dispensing applicators, either alone or in any combination thereof.

To attain this, the present invention generally comprises an elongated hollow handle having a first end and a curved second end, a head member integrally formed at the curved second end, a means for retaining a porous pad, the retaining means being frictionally attachable to the head member, and a lotion dispensing means for forcing a quantity of lotion disposed in the elongated hollow handle from an interior thereof, through the retaining means and into the porous pad.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new lotion dispensing applicator apparatus and method which has many of the advantages of the liquid dispensing applicators mentioned heretofore and many novel features that result in a new lotion dispensing applicator which is not anticipated, rendered obvious, suggested, or even implied by any of the prior art liquid dispensing applicators, either alone or in any combination thereof.

It is another object of the present invention to provide a new lotion dispensing applicator which may be easily and efficiently manufactured and marketed.

It is a further object of the present invention to provide a new lotion dispensing applicator which is of a durable and reliable construction.

An even further object of the present invention is to provide a new lotion dispensing applicator which is susceptible of a low cost of manufacture with regard to both materials and labor, and which accordingly is then susceptible of low prices of sale to the consuming public, thereby making such lotion dispensing applicator economically available to the buying public.

Still yet another object of the present invention is to provide a new lotion dispensing applicator which provides in the apparatuses and methods of the prior art some of the advantages thereof, while simultaneously overcoming some of the disadvantages normally associated therewith.

Still another object of the present invention is to provide a new lotion dispensing applicator for easily dispensing lotions from a refillable applicator and applying the dispensed lotions to hard to reach areas of the human body.

Yet another object of the present invention is to provide a new lotion dispensing applicator which includes an elongated hollow handle having a first end and a curved second end, a head member integrally formed at the curved second end, a means for retaining a porous pad, the retaining means being frictionally attachable to the head member, and a lotion dispensing means for forcing a quantity of lotion disposed in the elongated hollow handle from an interior thereof, through the retaining means and into the porous pad.

Still yet another object of the present invention is to provide a new lotion dispensing applicator that can be utilized with a plurality of different lotions such as medicated lotions, suntan lotions and sunblock lotions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
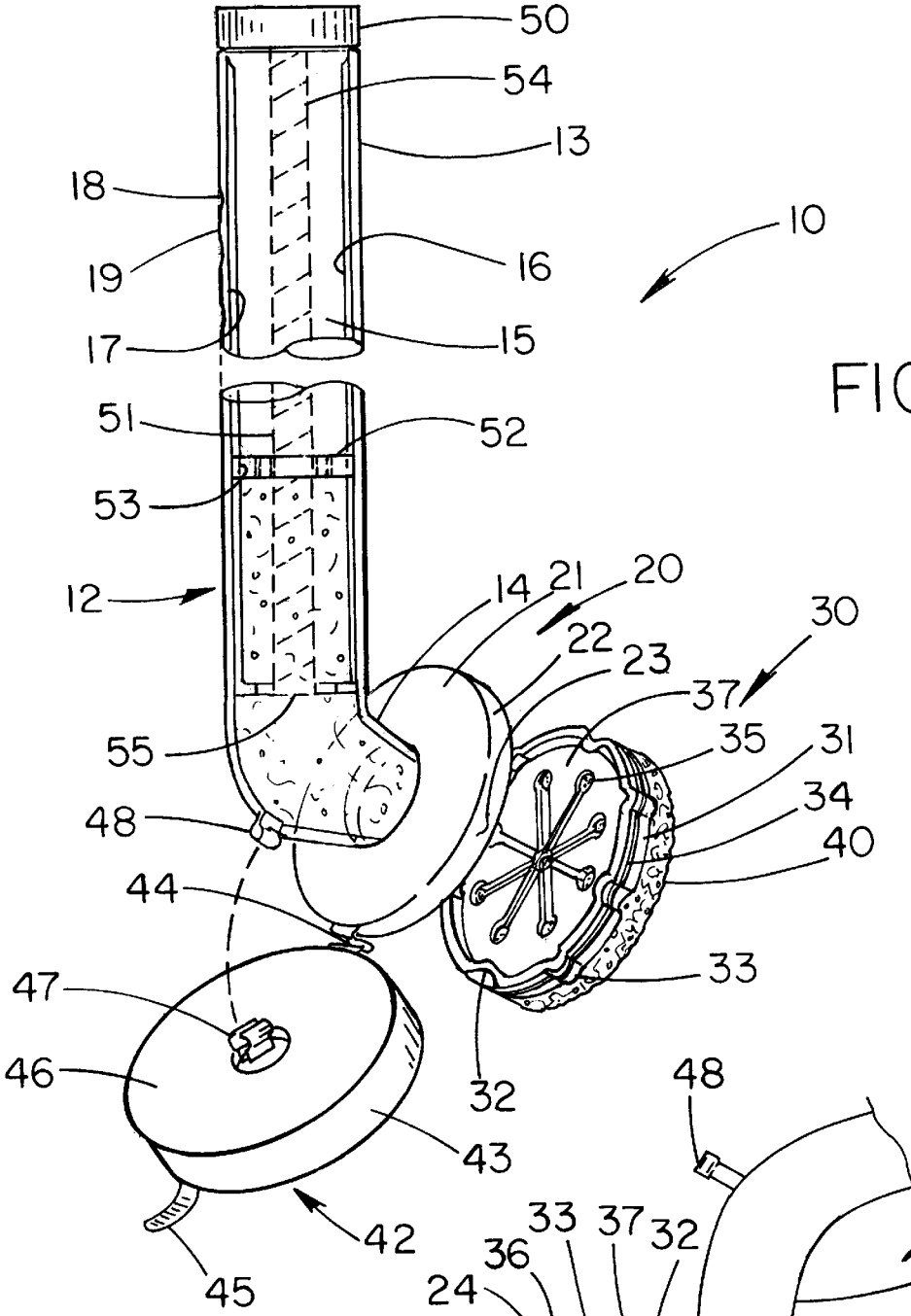
FIG. 1 is an exploded right side perspective view of a new lotion dispensing applicator according to the present invention.

With reference now to the drawings, and in particular to FIGS. 1 through 5 thereof, a new lotion dispensing applicator embodying the principles and concepts of the present invention and generally designated by the reference numeral 10 will be described.

More specifically, it will be noted that the lotion dispensing applicator 10 comprises an elongated hollow handle 12 having a first end 13 and a curved second end 14, a head member 20 integrally formed at the curved second end 14, a means for retaining a porous pad 40 and a lotion dispensing means. The elongated hollow handle 12 is preferably formed of a transparent plastic material to facilitate the visual inspection of the contents thereof and includes a gripping means 18 formed of ridges 19, the gripping means 18 formed proximate the first end 13.

With reference to FIG. 1 the lotion dispensing means is shown including a rotatable member 50 rotatably attached to the elongated hollow handle first end 13 in a manner well known in the art. Fixedly attached to the rotatable member 50 is shown a threaded member 51 which extends through an interior 15 of the elongated hollow handle 12 from the rotatable member 50 and terminates proximate the curved second end 14. A plunger member 52 having a threaded bore formed at a center thereof is shown threadingly received upon the threaded member 51. The plunger member 51 further includes a pair of opposing slots 53 formed at a periphery thereof, the opposing slots being receivable in a pair of opposing longitudinal ridges 16 formed on opposing surfaces of an inside wall 17 of the elongated hollow handle 12. In this manner the plunger member 51 can traverse the interior 15 from a position proximate the rotatable member 50 at a first end 54 of the threaded member 51 to a position proximate the second curved end 14 at a second end 55 of the threaded member 51 with the second curved end 14 providing a stop to the continued travel of the plunger member 51.

Figure 2:
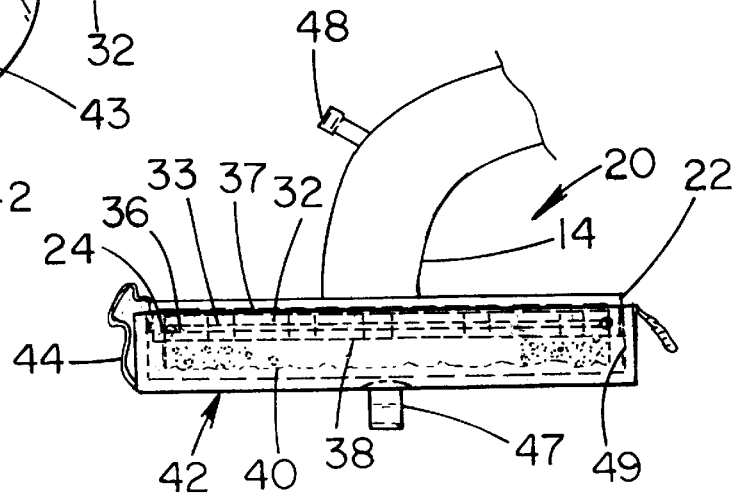
FIG. 2 is a cross sectional view of the head member and porous pad retaining means thereof.
Figure 3:
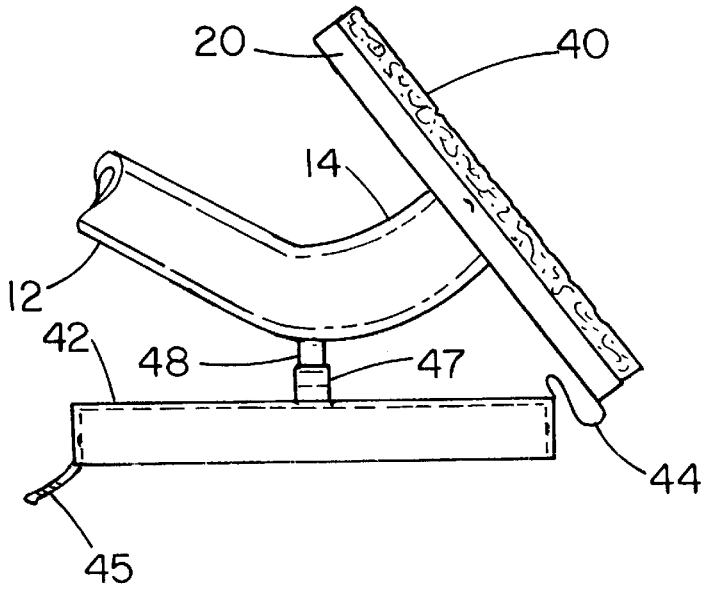
FIG. 3 is an fragmented illustration showing the lid attached to the elongated hollow handle curved second end.
Figure 4:
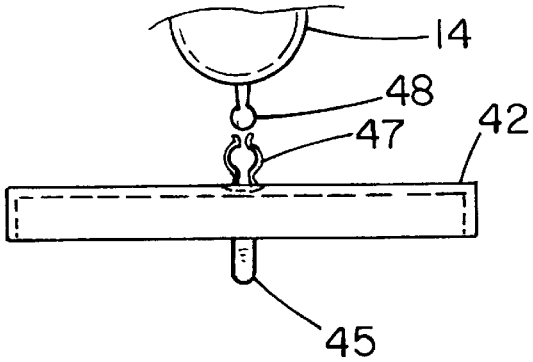
FIG. 4 is a side elevation view showing the clasp and knob.

With reference to FIGS. 1 and 2, the means for retaining the porous pad is shown including an apertured member 31 having an aperture 35 formed therethrough. The apertured member 31 further includes a top portion 37 and a bottom portion 38. Shown fixedly disposed upon the bottom portion 38 is a porous pad 40 of the type capable of holding liquids such as medicated lotions, suntan lotions, and sunblock lotions. The apertured member 31 further includes a ridged periphery 33 shown including a plurality of ridges and indentations 32 to facilitate the removal of the apertured member 31 from the head member 20 as hereinafter described. The ridged periphery 33 is further shown including a groove 34 formed therearound for receiving an O ring 36. In use the O ring 36 prevents the lotion from leaking from around the ridged periphery 33.

The ridged periphery 33 is dimensioned and configured to be frictionally engageable to an inside surface 24 of a head member lateral portion 22. With the apertured member 31 disposed within the head member 20, the top portion 37 is shown in abutting relationship to a head member top portion 21.

With reference to FIGS. 1–4, a lid 42 is shown removably receivable on the head member 20 in covering relationship to the means for retaining the porous pad. The lid 42 is shown including a lateral portion 43 having an inner surface 49 and a top portion 46. The lateral portion inner surface 49 is frictionally engageable to a plurality of protrusions 23 formed on the head member lateral portion 22. A hinge 44 is shown integrally formed on the lateral portion 43 for securement of the lid 42 to the head member 20. A tab 45 is shown integrally formed opposite the hinge 44 on the lateral portion 43. The tab 45 is provided to facilitate the removal of the lid 42 from the head member 20.

The lid 42 further includes a clasp 47 formed at a center of the top portion 46 thereof. The clasp 47 is dimensioned to be frictionally engageable to a knob 48 formed on the curved second end 14 of the elongated hollow handle 12.

Figure 5:
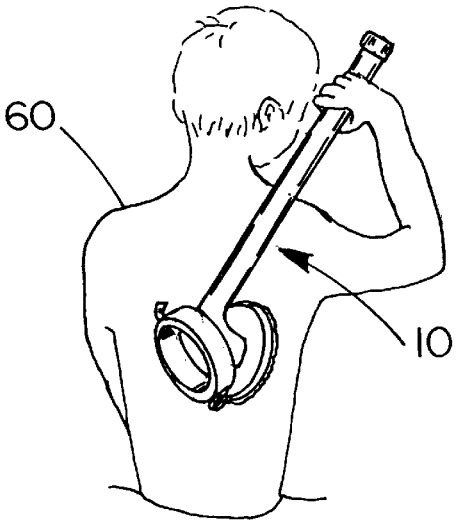
FIG. 5 is a perspective view showing the lotion dispensing applicator in use.

In use, the elongated hollow handle 12 is filled with a lotion by first removing the porous pad retaining means and filling the elongated hollow handle 12 with the plunger member 52 positioned proximate the first end 54 of the threaded member 51. The porous pad retaining means is then inserted in the head member 20 and the lotion dispensing applicator 10 is ready to use as shown in FIG. 5. When not in use the lid 42 can be positioned over the porous pad 40 to protect it from being soiled. Additionally, it is contemplated that the porous pad 40 may be replaced by removing it and affixing another porous pad 40 to the apertured member 31.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A lotion dispensing applicator comprising:

an elongated hollow handle having a first end and a curved second end, the first end further comprising a means for gripping the elongated hollow handle;

a head member integrally formed at the curved second end, the head member having a lateral portion and a top portion, the lateral portion having a plurality of protrusions formed therearound;

a porous pad fixedly attachable to the bottom portion of an apertured member, the apertured member further comprising a top portion and a ridged periphery having a groove formed therearound, the groove being for receiving an O ring, the ridged periphery being frictionally engageable to an inside surface of the head member lateral portion in such manner that the top portion of the apertured member is disposed in abutting relationship to the head member top portion;

a rotatable member rotatably attached to the elongated hollow handle first end;

a threaded member fixedly attached to the rotatable member and extending through an interior of the elongated hollow handle from the rotatable member to a position proximate the curved second end of the elongated hollow handle;

a plunger member having a threaded bore formed at a center thereof, the plunger member threaded bore being threadingly receivable upon the threaded member, the plunger member further having a pair of opposing slots formed at a periphery thereof, the opposing slots being receivable in a pair of opposing longitudinal ridges formed on opposing surfaces of an inside wall of the elongated hollow handle;

a lid removably receivable on the head member in covering relationship to the porous pad, the lid further comprising a top portion and a lateral portion having an inner surface, the inner surface being frictionally engageable to the protrusions formed on the lateral portion of the head member, the lid lateral portion further comprising an integral hinge and an integral tab formed opposite the hinge, the hinge being for hinged connection to the head member; and a clasp formed at a center of the lid top portion, the clasp being frictionally engageable to a knob formed on the curved second end of the elongated hollow handle.

* * * * *